US005926553A

United States Patent [19]

Keyhl et al.

[11] Patent Number: 5,926,553

[45] Date of Patent: Jul. 20, 1999

[54] METHOD FOR MEASURING THE CONSERVATION OF STEREOPHONIC AUDIO SIGNALS AND METHOD FOR IDENTIFYING JOINTLY CODED STEREOPHONIC AUDIO SIGNALS

[75] Inventors: Michael Keyhl, Nünberg; Jürgen Herre, Buckenhof; Christian Schmidmer, Fürth; Karlheinz Brandenburg; Dieter Seitzer, both of Erlangen, all of Germany

[73] Assignee: Fraunhofer-Gesellschaft zur Forderung der Angewandten Forschung EV, Munich, Germany

[21] Appl. No.: 08/817,749

[22] PCT Filed: Oct. 11, 1995

[86] PCT No.: PCT/EP95/04008

§ 371 Date: Jul. 21, 1997

§ 102(e) Date: Jul. 21, 1997

[87] PCT Pub. No.: WO96/12384

PCT Pub. Date: Apr. 25, 1996

Related U.S. Application Data

[30] Foreign Application Priority Data

Oct. 18, 1997 [DE] Germany ..... 44 37 287

[51] Int. Cl.[6] ..... H04H 5/00

[52] U.S. Cl. ..... 381/2

[58] Field of Search ..... 381/2, 1, 12, 58; 704/200

[56] References Cited

FOREIGN PATENT DOCUMENTS

| | | |
|---|---|---|
| 0559383A1 | 9/1993 | European Pat. Off. . |
| 3627679 A1 | 2/1988 | Germany . |
| 3805946 A1 | 9/1989 | Germany . |
| 4217276 C1 | 4/1993 | Germany . |
| 4331376 C1 | 11/1994 | Germany . |
| WO 89/08357 | 9/1989 | WIPO . |

OTHER PUBLICATIONS

K. Brandenburg and T. Sporer: "NMR" and "Masking Flag": Evaluation of Quality Using Perceptual Proceedings of AES 11th International Conference, pp. 169–179, Jan. 1992.

*Primary Examiner*—Vivian Chang
*Attorney, Agent, or Firm*—Wolf, Greenfield & Sacks, PC

[57] ABSTRACT

Jointly processed stereophonic audio signal properties are identified using a stereophonic signal as reference signal and creating a signal for testing by processing the stereophonic signal, e.g. by coding and subsequently decoding it. Both signals are transformed into the frequency domain to create representative spectral data for the respective subbands. Correlation coefficients are determined for each subband both of the reference signal and also of the signal for testing on the basis of the spectral data of the channels of the reference signal or of the signal for testing. From the comparison of the correlation coefficients belonging to the same subband, jointly processed stereophonic audio signals are detected if at least one of the correlation coefficients of the signal for testing greatly exceeds the correlation coefficient of the reference signal for the same subband.

4 Claims, 1 Drawing Sheet

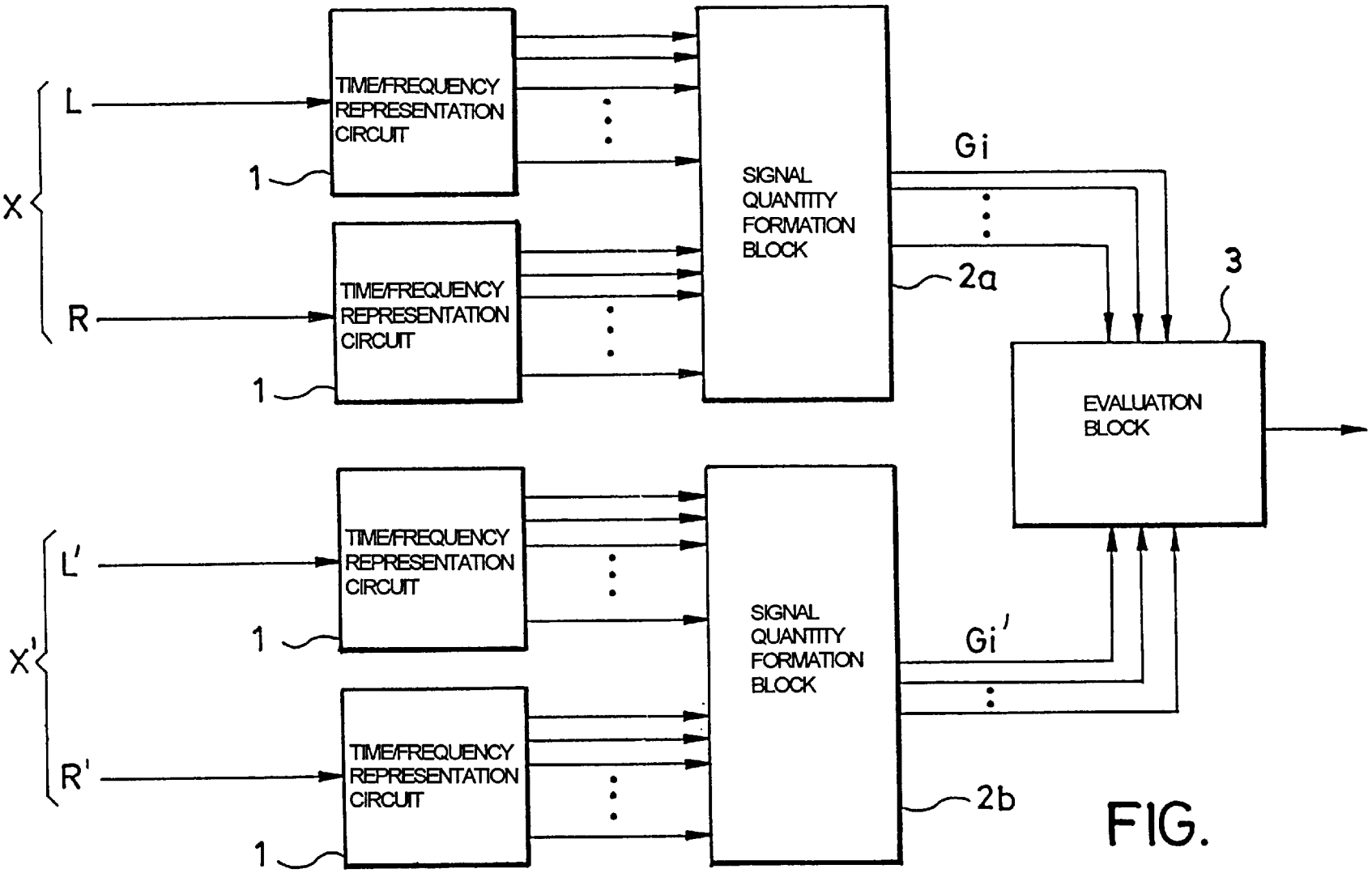
FIG.

METHOD FOR MEASURING THE CONSERVATION OF STEREOPHONIC AUDIO SIGNALS AND METHOD FOR IDENTIFYING JOINTLY CODED STEREOPHONIC AUDIO SIGNALS

FIELD OF THE INVENTION

According to a first aspect, the present application refers to a method for measuring the conservation of stereophonic audio signals when employing a processing technique or a coding technique on stereophonic signals.

According to a further aspect, the present invention refers to a method for identifying jointly processed or coded stereophonic audio signals.

DESCRIPTION OF THE PRIOR ART

For the purposes of data reduction, techniques for the joint stereo coding of stereophonic audio signals are being used increasingly in the case of very high compression factors. A known coding technique of this type is the so-called "intensity stereo technique". When employing the intensity stereo technique, audible distortions may occur in the stereo acoustic pattern. It is therefore of interest to make it possible to detect such distortions by means of measurement. It is also of interest to establish whether a coded and then decoded signal was coded using a joint stereo coding technique.

From the prior, non-prepublished German patent application P 43 31 376.0-31, a method for determining the type of coding to be chosen for coding at least two signals is known, in which a transformation of signals into the frequency domain is performed and, on the basis of spectral values, a similarity measure is determined, on the basis of which the type of coding to be chosen is specified. Here, one of the signals in a coding type which is used if a high similarity measure is detected and which is e.g. the intensity stereo coding, is first coded and then decoded to create a coding-error-afflicted signal. Both this signal and the original signal, which is not afflicted with the coding error, are transformed into the frequency domain. Spectral values of the respective corresponding channels, e.g. of the left or e.g. of the right channel in the case of a twin-channel stereo signal, of mutually corresponding subbands both of the transformed coding-error-afflicted signal and of the transformed coding-error-free signal are compared with one another employing a masked hearing threshold, where the masked hearing threshold is determined by psychoacoustic calculations. This comparison of the spectral values of the respective corresponding channels forms the basis for the determination of a similarity measure, on the basis of which the coding type to be chosen is specified.

A known measurement method for the hearing-related evaluation of distortions in the stereo acoustic pattern is the so-called NMR method, which is known from the following prepublication: K. Brandenburg, T. Sporer: "'NMR' and 'masking flag': Evaluation of Quality using Perceptual Criteria", Proc. of the 11th International AES Conference on Audio Test and Measurement, Portland 1992 pp. 169–179. However, it is not possible to record the stereophonic acoustic pattern with a method of this kind.

Furthermore, with the known methods described above it is not possible to determine whether the coding technique used is a joint stereo coding one.

From WO-A-8908357 a method for the quantitative real-time recording of the audibility of disturbances in the coding of audio signals is known, in which a processed audio signal which is to be compared, obtained e.g. by coding and subsequent decoding, is correlated with the original signal in order to establish the signal delay of a system processing the signal, whereupon the difference of the signals for comparison is formed in the time domain, taking into account the ascertained signal delay time. The spectral composition both of the original signal and also of the difference signal is then formed. From the spectral composition of the original signal, the masked hearing threshold of the human ear is determined and compared with the spectral composition of the difference signal. The spectral regions of the difference signal which exceed the masked hearing threshold serve for the quantitative recording of the audibility of disturbances in the signal processing.

SUMMARY OF THE INVENTION

It is an object of the present invention to disclose a method for identifying jointly coded stereophonic audio signals.

This object is achieved by a method for identifying jointly processed stereophonic audio signals, with the following steps:

- providing a stereophonic signal as reference signal;
- processing the stereophonic signal by means of the processing technique to provide a signal for testing derived from this stereophonic signal;
- transforming the reference signal and the signal for testing into the frequency domain to create representative spectral data for the respective subbands;
- determining correlation coefficients for each subband of the reference signal, in each case on the basis of the spectral data of the channels of the reference signal;
- determining correlation coefficients for each subband of the signal for testing, in each case on the basis of the spectral data of the channels of the signal for testing;
- comparing the correlation coefficients belonging to the same subband; and
- detecting jointly processed stereophonic audio signals if at least one of the correlation coefficients of the signal for testing greatly exceeds the correlation coefficient of the reference signal for the same subband.

BRIEF DESCRIPTION OF THE DRAWINGS

Preferred embodiments of the methods according to the present invention will be described in more detail below making reference to the enclosed drawing, in which:

The single FIGURE shows a block diagram of a circuit for implementing the methods according to the present invention.

DESCRIPTION OF THE PREFERRED EMBODIMENTS OF THE INVENTION

The method according to the first invention aspect now to be described serves to measure the conservation of stereophonic audio signal properties when using a coding technique on stereophonic signals and serves in particular to measure the conservation of psychoacoustic quantities which are important for an undisturbed stereo acoustic pattern when using a joint stereo coding technique.

A signal for testing X' with the channels L' and R' is formed on the basis of a stereophonic signal X with the channels L and R by coding and subsequent decoding. In the preferred embodiment, a joint stereo coding technique, preferably the intensity stereo coding technique, is used. The signal for testing X' and the reference signal X are fed, in delay-compensated form, to inputs of representation circuits 1, which perform a time/frequency representation of the signal for testing X' and the reference signal X. Such representation circuits 1 are known per se in the prior art and can be implemented by means of a filter bank or by means of a transformation circuit with subsequent grouping of the output values. In the preferred application of the FFT (the fast Fourier transformation), the output quantities of the representation circuits 1 are the respective spectral data for the respective subbands.

In a function block 2*a,* signal quantities Gi are formed for each subband i of the reference signal X, in each case on the basis of the spectral data of the right and left channels R, L of the reference signal. In a corresponding function block 2*b,* signal quantities Gi' are formed for each subband i of the signal for testing X', in each case on the basis of the spectral data of the left and right channels L', R'. In an evaluation block 3, to which the signal quantities Gi', $G^i$ are fed, the signal quantities Gi, Gi' belonging to the same subband i are compared with one another in each case. From this comparison, as will be clarified in detail below, conclusions are drawn as to the conservation of the stereophonic audio signal properties or the disturbance of the stereo acoustic pattern for the coding technique being used.

The size of the subbands, which are specified by the representation circuits 1, is preferably chosen according to the frequency resolution of the human auditory system or according to the so-called "Bark" scale.

For the purposes of the method according to the present invention, the use of different signal quantities is conceivable, among them the special cases, explained hereafter, of the use of the correlation coefficients and the level differences. Every type of signal quantity can be considered, insofar as it is formed, on the one hand, for each subband of the reference signal, in each case on the basis of the spectral data of the individual channels of the reference signal, and, on the other hand, for each subband of the signal for testing, in each case on the basis of the spectral data of the channels of the signal for testing.

In the preferred embodiment the signal quantities Gi, Gi' comprise the correlation coefficient $k_i$, which specifies the correlation of the spectral data of the individual channels for the respective subbands i, on the one hand for the signal for testing X' and, on the other hand, for the reference signal X.

In the special case of the use of a stereophonic signal with 2 channels l, r, the correlation coefficient $k_i$ for each subband i is given by the following equation:

$$k_i = \frac{\sum_{j=1}^{n} (l_{i;j} \cdot r_{i;j})}{\sqrt{\sum_{j=1}^{n} l_{i;j}^2 \cdot \sum_{j=1}^{n} r_{i;j}^2}}$$

In the equation for the calculation of the correlation coefficient $k_i$ and in the equation for the calculation of the level difference $dL_i$, $l_{i;j}$ and $r_{i;j}$ designate the jth temporal spectral value of the ith subband in the left and right channel.

Furthermore, the signal quantities Gi, Gi' comprise the level differences $dL_i$, i.e. the differences in the levels of the spectral data of the left and right channels for the respective subbands i both for the reference signal X and for the signal for testing X'. The level differences are determined by the following equation:

$$dL_i = 10 \cdot \log_{10}\left(\frac{\sum_{j=1}^{n} l_{i;j}^2}{\sum_{j=1}^{n} r_{i;j}^2}\right)$$

The above formulae for the correlation coefficients and the level differences are valid in the case where the representation circuits 1 are implemented as a filter bank.

The evaluation block 3 assesses the conservation of the stereophonic audio signal properties by comparing the signal quantities belonging to the same subband i. If the level differences $dL_i'$, $dL_i$ for the signal for testing X' and the reference signal X differ, it can be concluded that there is impairment of the local representation in the test signal or a disturbance of the stereo acoustic pattern due to the coding method being used.

If the correlation coefficient $k_i$ of the signal for testing X' is considerably higher for a subband i than the corresponding correlation coefficient $k_i$ for the same subband of the reference signal X, it can be concluded that a joint stereo coding technique, in particular that of intensity stereo coding, has been used.

We claim:

1. Method for identifying jointly processed stereophonic audio signals, comprising the steps of:

providing a stereophonic signal as reference signal;

processing the stereophonic signal by means of the processing technique to provide a signal for testing derived from this stereophonic signal;

transforming the reference signal and the signal for testing into the frequency domain to create representative spectral data for the respective subbands;

determining correlation coefficients for each subband of the reference signal, in each case on the basis of the spectral data of the channels of the reference signal;

determining correlation coefficients for each subband of the signal for testing, in each case on the basis of the spectral data of the channels of the signal for testing;

comparing the correlation coefficients belonging to the same subband; and detecting jointly processed stereophonic audio signals if at least one of the correlation coefficients of the signal for testing greatly exceeds the correlation coefficient of the reference signal for the same subband.

2. Method according to claim 1, wherein the step of processing the stereophonic signal by means of the processing technique to provide a signal for testing derived from this stereophonic signal comprises the following step:

coding and subsequent decoding of the stereophonic signal by means of the coding technique to provide the signal for testing.

3. Method according to claim 1 or 2, characterized in that jointly coded stereophonic audio signals are identified if at least one of the correlation coefficients of the signal for testing exceeds the correlation coefficient of the reference signal for the same subband by at least 0,25.

4. Method according to claim 1, wherein the stereophonic signal has two channels and for which the correlation coefficients for each subband are given by the following equation:

$$k_i = \frac{\sum_{j=1}^{n} (l_{i;j} \cdot r_{i;j})}{\sqrt{\sum_{j=1}^{n} l_{i;j}^2 \cdot \sum_{j=1}^{n} r_{i;j}^2}}$$

where $l_{i;j}$ and $r_{i;j}$ designate the jth temporal spectral value of the ith subband in the left or right channel.

* * * * *